US009955846B2

(12) United States Patent
Tempelmann

(10) Patent No.: US 9,955,846 B2
(45) Date of Patent: May 1, 2018

(54) DISHWASHER COMPRISING A BISTABLE FILTER AND A METHOD FOR MOUNTING A BISTABLE FILTER IN A DISHWASHER

(75) Inventor: Sarah Tempelmann, Hamburg (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1137 days.

(21) Appl. No.: 14/005,467

(22) PCT Filed: Mar. 16, 2012

(86) PCT No.: PCT/EP2012/054704

§ 371 (c)(1),
(2), (4) Date: Sep. 16, 2013

(87) PCT Pub. No.: WO2012/123581

PCT Pub. Date: Sep. 20, 2012

(65) Prior Publication Data

US 2014/0034093 A1 Feb. 6, 2014

(30) Foreign Application Priority Data

Mar. 17, 2011 (EP) ..... 11002196

(51) Int. Cl.
*A47L 15/42* (2006.01)

(52) U.S. Cl.
CPC ..... *A47L 15/4202* (2013.01); *A47L 15/4204* (2013.01); *Y10T 29/49826* (2015.01)

(58) Field of Classification Search
CPC ..... A47L 15/4202; A47L 15/4204; A47L 15/4208; D06F 39/10; D06F 43/085
See application file for complete search history.

(56) References Cited

U.S. PATENT DOCUMENTS 3,179,116 A * 4/1965 Jacobs ..... A47L 15/4206 134/104.1
3,429,444 A * 2/1969 Robandt ..... D06F 39/10 210/356

(Continued)

FOREIGN PATENT DOCUMENTS

DE 79 32 046 U1 3/1981
EP 1 340 448 A2 9/2003

(Continued)

OTHER PUBLICATIONS

International Search Report for Application No. PCT/EP2012/054704, dated Apr. 19, 2012.

*Primary Examiner* — Marc Lorenzi
(74) *Attorney, Agent, or Firm* — Alston & Bird LLP

(57) ABSTRACT

The present invention relates to a dishwasher comprising a washing chamber, a water circulating system and a water filtering system, said water filtering system is arranged in the lower part of the washing chamber, wherein said water filtering system comprises a filter through which at least some of the circulating water is passing, said filter having bistable characteristics such that it has two stable shapes and is flippable from one stable position to the other by a force applied on the filter in a direction toward the other stable shape, wherein the filter is securable in the lower part of the washing chamber by flipping the filter from one stable shape to the other. The invention furthermore relates to a method for mounting the filter in a dishwasher.

16 Claims, 4 Drawing Sheets

(56) References Cited

U.S. PATENT DOCUMENTS 3,455,456 A * 7/1969 Wolters ..... B01D 35/16 210/143
3,500,011 A * 3/1970 Rickel ..... B01D 29/01 210/386
3,595,438 A * 7/1971 Daley ..... A47L 15/4436 222/67
3,622,003 A * 11/1971 Czech ..... B01D 29/114 210/108
4,020,865 A * 5/1977 Moffat ..... A47L 15/4436 137/268
5,554,284 A * 9/1996 Bartelt ..... B01D 29/15 210/356
7,909,941 B2 * 3/2011 Classen ..... A47L 15/4206 134/10
2001/0032822 A1 * 10/2001 Koslow ..... A47J 31/605 210/767
2004/0050774 A1 * 3/2004 Jerg ..... A47L 15/4208 210/498
2004/0079399 A1 4/2004 Jerg
2007/0137265 A1 * 6/2007 Shikamori ..... D06F 39/10 68/208
2007/0227955 A1 * 10/2007 Walde ..... B01D 35/157 210/109
2007/0246421 A1 * 10/2007 Walde ..... C02F 1/003 210/477
2009/0283111 A1 * 11/2009 Classen ..... A47L 15/4206 134/10

FOREIGN PATENT DOCUMENTS

EP 1 424 034 B1 6/2004
EP 2 179 685 A1 4/2010
GB 805 489 A 12/1958
GB 1 069 727 A 5/1967
WO WO-2004/096005 A1 11/2004
WO WO 2009133023 A1 * 11/2009 ..... D06F 58/22
WO WO 2011147009 A2 * 12/2011 ..... B01D 29/27

* cited by examiner

DISHWASHER COMPRISING A BISTABLE FILTER AND A METHOD FOR MOUNTING A BISTABLE FILTER IN A DISHWASHER

CROSS REFERENCE TO RELATED APPLICATIONS

This application is a national stage application filed under 35 U.S.C. 371 of International Application No. PCT/EP2012/054704, filed Mar. 16, 2012, which claims priority from European Patent Application No. 11002196.1, filed Mar. 17, 2011, each of which is incorporated by reference herein in its entirety.

FIELD OF THE INVENTION

The present invention relates to a dish washer and a method for mounting a bistable filter in a dishwasher.

BACKGROUND OF THE INVENTION

Dishwashers are a frequently used household machine. The dirty items are placed in a washing chamber in which heated water is circulated in order to wash the different items in the dishwasher. The water is circulated in the washing chamber by a pumping device and sprayed on the dirty dish from a number of nozzles arranged on rotating arms in the washing chamber. The water flows downwards in the washing chamber and is passing through a filter system having a flat filter that is supported around its outer periphery by a supporting edge with a shape corresponding to the shape of the filter and secured in the intended position by a central filter unit, before it is collected in a sump in the lower section of the washing chamber and lead to the pump. Examples of different filter arrangements of the described type for dishwashers are known from EP1 340 448 and EP 1 424 034B1.

In order to provide the required filter area, the flat filter has a considerable size and the widely changing temperatures in the washing chamber in combination with the size and shape of the flat filter makes it difficult to ensure the desired sealing between the outer periphery of the filter and the supporting edge, especially since the filter regularly is removed for cleaning purpose. In case of dirty water bypassing the filter, the dirty water will continue to the pump and further to the water spray nozzles that in worst case get blocked by the particles in the water. Furthermore the filter arrangement is expensive to manufacture since the arrangement comprises several different components that must fit properly together to ensure the desired securing of the different filter arrangement components as well as the proper sealing between the different components.

There is consequently a need for an improved dishwasher that ensures that no dirty water is bypassing the filter.

SUMMARY OF THE INVENTION

The present invention, defined in the appended claims, provides a dishwasher and a method for mounting a filter in a dishwasher that fulfils the needs defined above.

The dishwasher arrangement according to the invention comprises a washing chamber, a water circulating system and a water filtering system, said water filtering system is arranged in the lower part of the washing chamber, wherein said water filtering system comprises a filter through which at least some of the circulating water is passing, said filter having bistable characteristics such that it has two stable shapes and is flippable from one stable position to the other by a force applied on the filter in a direction toward the other stable shape, wherein the filter is securable in the lower part of the washing chamber by flipping the filter from one stable shape to the other.

The dishwasher according to the invention solves the drawbacks identified above since the securing of the filter in the lower section of the washing chamber is achieved by flipping the filter from one stable shape towards the other instead of using a further separate filter unit for securing the filter in the intended position. The required tolerances between the different components are thereby reduced considerably.

In one embodiment of the dishwasher, said filter has an outer periphery positioned in a recess with a shape corresponding to the shape of the outer periphery of the filter, said recess being arranged in the lower part of the washing chamber. The positioning of the outer periphery of the bistable filter in a recess ensures the desired sealing between the filter and the lower part of the washing chamber. This embodiment reduces the risk for water bypassing the filter around the filter periphery after the filter has been removed and returned to its intended position after cleaning. Furthermore positioning of the filter in the desired position is facilitated.

In one embodiment of the dishwasher, the filter, when mounted in the lower part of the washing chamber, is arranged in an intermediary shape between its two stable shapes. This is favourable since the fact that the filter is maintained in the intermediary shape result in that, due to the bistable characteristic, the filter will be pushed towards a contact surface of the recess which improves the sealing between the recess and the outer periphery of the filter. The pressure applied by the filter depends on the design and material of the filter.

In one embodiment of the dishwasher, the filter is arranged between a contact surface of the recess and a support surface stationary in relation to the washing chamber and positioned in such a way that the filter is maintained in the intermediary shape and the outer periphery of the filter is pressed against the contact surface of the recess.

Different embodiments of the filter design are possible, for example the filter, in the plane of the outer periphery of the filter, could have a filter base with a rectangular or triangular shape, and a corresponding pyramid shape with a top angle of the pyramid exceeding 120°. Alternatively the filter could have a filter base with a substantially circular or oval shape and a corresponding cone shape with a top angle of the cone exceeding 120°. The filter base shape is adapted to fit properly in the lower part of the washing chamber. Furthermore, top angles exceeding 120° are favourable since the required space for the filter in the washing chamber is reduced.

In one embodiment of the dishwasher, the filter is shaped like a cone, or pyramid, with a substantially flat top surface substantially parallel to the filter base. This embodiment provides a filter with the desired features and that requires a limited space within the washing chamber.

In one embodiment of the filter arrangement, the water filtering system furthermore comprises a filter unit arranged in an opening in the top surface of the filter. The filter unit is connected to the filter and comprises a handle for mounting and/or de-mounting of the filter and the filter unit. The handle makes it easy to apply the required force for flipping the filter between the two different stable shapes of the bistable filter.

In one embodiment of the dishwasher, the support surface is arranged on the filter unit. This is a favourable embodiment since the filter, positioned in the intermediary shape, will apply a force on both the contact surface of the recess and on the support surface of the filter unit. The force on the filter unit could thereby be used for securing the filter unit in the desired position in the lower part of the washing chamber.

In one embodiment of the dishwasher, a number of protrusions are arranged around the periphery of the filter in order to generate a change of the filter diameter when the filter is flipped from one of the stable positions towards the other. This embodiment is very favourable since the protrusions that are extending from the periphery of the filter away from the centre of the filter will improve the securing strength of the filter in the recess since the protrusions, when the filter is flipped towards the securing position of the filter, increases the diameter of the filter and consequently improves the fastening of the filter.

Finally, the invention relates to a method for mounting a bistable filter having two stable shapes in a dishwasher comprising a washing chamber. The bistable filter is flipped from one position to the other by applying a force on the filter in a direction toward the other stable shape and has an outer periphery intended to be fitted in a corresponding recess in the washing chamber. The method comprises the steps: a) positioning the outer periphery of the filter in the recess; b) applying a force on the filter in the direction towards the other stable shape of the filter, thereby flipping the filter towards the other stable shape in order to secure the filter in the intended position.

In one embodiment of the method, the filter is prevented from flipping all the way towards the other stable shape by a support surface that maintains the filter in an intermediary shape so that the filter is pressing against a contact surface of the recess.

In one embodiment of the method, the filter is positioned with the outer periphery in the recess and secured by pressing the filter downwards thereby flipping the filter towards the other stable shape. This embodiment is favourable since the force could be easily applied and the filter will require a limited space within the washing chamber.

The force applied on filter must exceed the spring force of the bistable filter in order to achieve the desired flipping of the filter from one position towards the other. As a consequence of the bistable characteristic of the filter, each specific filter design has a spring force resulting from the shape and material of the filter and in order to achieve the desired flipping between the stable shapes of the filter the applied force must exceed the spring force of the filter.

BRIEF DESCRIPTION OF THE DRAWINGS

Different embodiments of the invention are schematically illustrated in the appended figures.

FIG. 2 illustrates a schematic cross sectional view of the outer periphery of the filter.

DETAILED DESCRIPTION OF EMBODIMENTS

Figure 1:
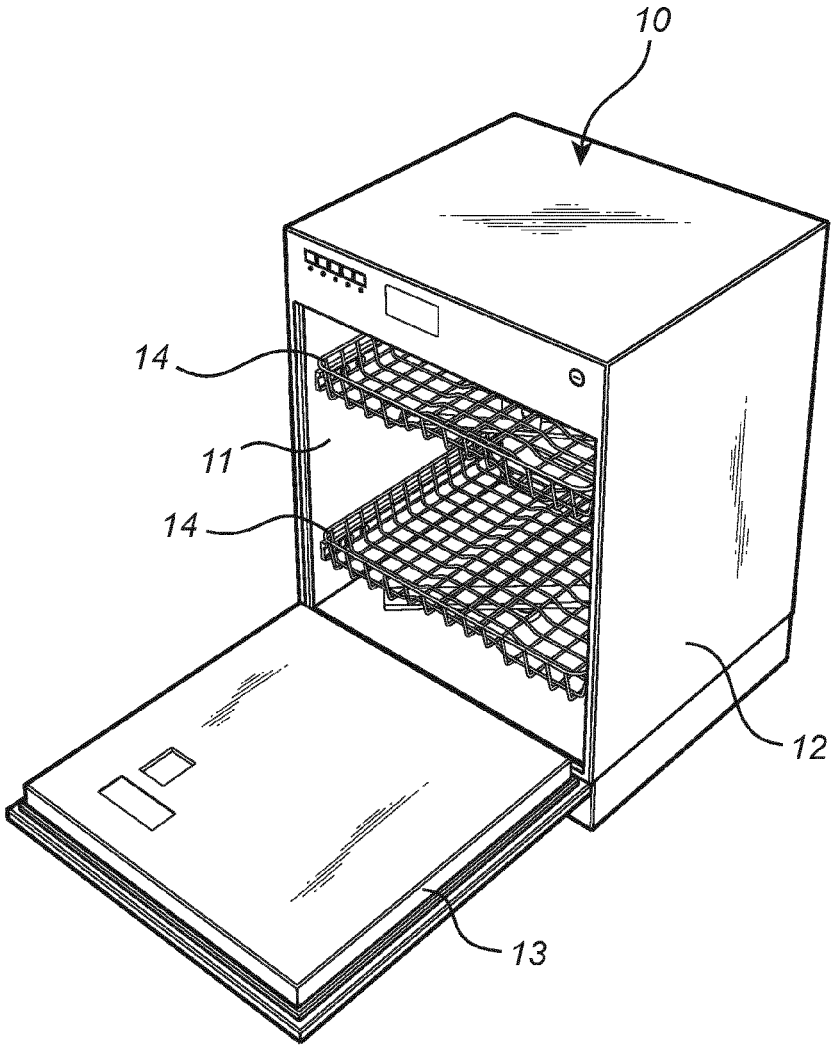
FIG. 1 illustrates a perspective view of a dishwasher.

In FIG. 1 a schematic dishwasher 10 is illustrated. The dishwasher comprises a washing chamber 11 surrounded by a cabinet 12. Between the washing chamber 11 and the cabinet 12 insulation is preferably arranged to reduce the amount of noise transmitted from the dishwasher, and reduce the temperature of the cabinet 12. The dishwasher furthermore comprises a door 13 in order to make it possible to access, and close, the washing chamber 11. In the washing chamber 11 one, or more, baskets 14 for the dirty items is arranged.

During use, heated water is circulating in the washing chamber 11 by a water circulating system in order to clean the dirty items positioned in the washing chamber. The water is sprayed on the items by nozzles arranged at different locations within the washing chamber and flowing, by gravity, to the lower section of the washing chamber that is formed as a tub 15 to collect the flowing water. In the bottom of the tub 15, a water filtering system is arranged. The object of the water filtering system is to remove dirt and particles from the used water before the water is reused and once again is sprayed into the washing chamber. The filtering system improves the final washing result and ensures the function of water circulating system that otherwise could get blocked by dirt and particles in the used water.

The water filtering system comprises a filter 20 arranged substantially horizontal in the tub 15 so that the water flows through the filter 20 before the filtered water continues to a sump 16 in the bottom of the washing chamber from which water is lead by a pump and connecting tubes to the different nozzles in the washing chamber. The specific design of the sump is not illustrated in the figures and could differ depending on the size and use of the dishwasher. The collected particles are collected in the sump separate from the filtered water that is lead to a pump for transport to the different nozzles.

Figure 2A:
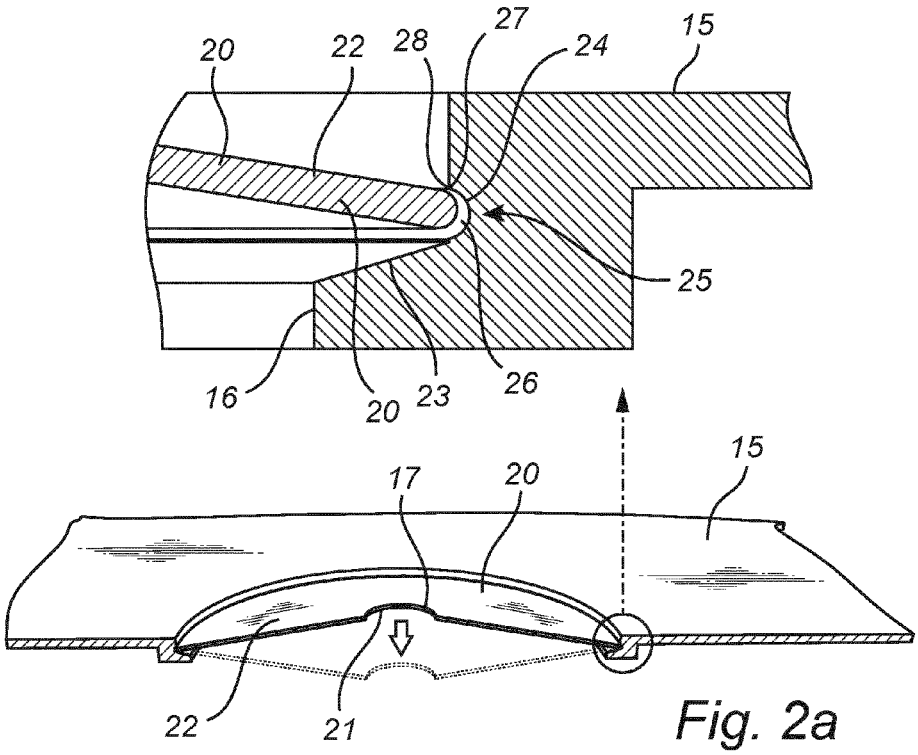
FIGS. 2*a* and 2*b* illustrates a schematic cross sectional view of the bistable filter before and after the filter is secured in the lower section of the washing chamber.
Figure 2B:
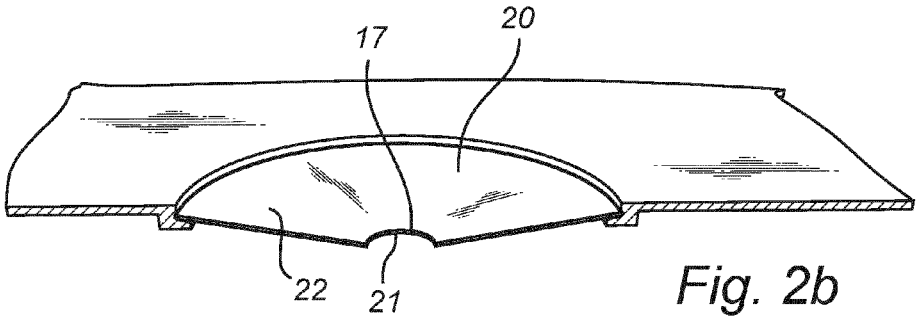

The filter 20, illustrated in FIGS. 2, 2*a* and 2*b*, is in this embodiment formed like a cone with a substantially circular filter base, a flat top surface 21 substantially parallel to the base of the cone and an angled filter surface 22 extending between a filter outer periphery 26 and the flat top surface 21. An opening 17 is arranged in the top surface 21. The size of the filter is adapted to ensure the desired filtering capacity for the specific dishwasher it is intended to be fitted in but the filter area is normally designed to have a considerably large size to ensure the desired filter capacity even though parts of the filter are blocked by collected particles and dirt.

The filter base could however also have other shapes like for example circular, oval, rectangular or triangular. The filter shape is then modified to a pyramid with a base corresponding to the shape of the filter base. If the filter has a substantially circular or oval base the filter shape could correspond to a section of a sphere, in other words have the shape of a cup with a curved filter surface. The entire filter could be made of a filtering material in order to maximize the filter area, alternatively selected areas of the filter surface are made of a filtering material.

In FIG. 2, selected parts of the filter 20 and the recess 25 according to the invention are illustrated. In the tub 15, in the lower section of the washing chamber 11, the recess 25 is arranged. The recess 25 comprises a rim 23 with a shape corresponding to the peripheral shape of the filter 20. The rim 23 is arranged in a plane substantially horizontal and parallel to the plane of the outer periphery of the filter and is angled in relation to the horizontal plane to make room for the filter when the filter is flipped towards the shape of the filter when in the secured position. The rim 23 is forming a conical section extending downwards towards the sump 16 in the bottom of the washing chamber 11 and is not intended to be in contact with the filter surface 22 when the filter 20 is flipped towards the securing position. The rim 23 facilitates the positioning of the filter in the recess 25 and prevents the filter from being pushed too far down in the sump 16.

The recess 25 furthermore comprises a C-shaped groove 24 arranged in the upper end of the rim 23 with the open side of the groove 24 facing towards the outer periphery 26 of the filter. The rim 23, in combination with the groove 24, forms the recess 25. The actual shape of the groove could differ as long as it corresponds to the shape of the outer periphery 26 of the filter 20. The lower part of the C-shaped groove 24 is meeting the rim 23, and the upper part of the groove 24 is forming a contact surface 27, illustrated in FIG. 2, extending around the tub 15. When the filter 20 is secured in the recess 25, and flipped towards the shape where the top surface of the filter is positioned below the plane of the filter base, the outer periphery 26 of the filter will rest against the contact surface 27 of the recess 25.

The contact surface 27 is supposed to be in contact with the outer periphery 26 of the filter 20 in the secured position to avoid water bypassing the filter around the outer periphery of the filter. The radius from the centre of the filter 20 to the edge 28 of the groove 24 is smaller than the radius of the outer periphery 26 of the filter 20 in order to provide a reliable securing of the filter 20 when the filter is flipped into the securing position of the filter 20. The difference in radius between the outer periphery 26 of the filter 20 and the edge 27 must however be small enough to make it possible to snap-fit the filter 20 in the recess 25.

The filter 20 is made either of sheet-metal or a plastic material that are able to withstand the changing temperatures in the washing chamber 11 without deforming. In order to maximize the water volume that is allowed to pass the filter 20, the entire filter 20 preferably is made of a filter material.

The schematically illustrated filter 20 in the figures has a substantially constant thickness but the filter could be modified in a number of different ways without departing from the scope of the invention. For example, the outer periphery of the filter could have a different shape to provide a reliably securing of the filter in the recess and to provide the desired sealing between the outer periphery of the filter and the contact surface of the recess. In order to achieve a durable sealing between the outer periphery 26 of the filter 20 and the contact surface of the recess different material combinations could be used such as a plastic or rubber coating on one of the surfaces in contact with each other.

The filter 20 is designed to have bistable characteristic which means that it has two different stable shapes. These stable shapes are, due to the characteristics of the bistable filter, arranged on opposite sides of the plane defined by the filter base, for example illustrated in FIGS. 2*a* and 2*b*. The bistable character is achieved by the design of the filter in combination with an elastic material that makes it possible for the filter to flip from one position towards the other without breaking. The design of the filter and the selection of material are both parameters that could be used in order to design a filter with the desired properties. For example, a filter made of a material with higher E-module will require a larger force to flip from one position to the other than a filter made of a material with lower E-module, and a filter with less curvature or larger top angle will be easier to flip from one position towards the other than a filter with more curvature or smaller top angle if the same material is used. Equally a filter made of a material with higher E-module will have a larger spring force than a filter made of a material with lower E-module.

The bistable filter 20 has a first stable position where the flat top surface 21 is located above the plane of the filter base, illustrated in FIG. 2*a*, and a second one where the top surface 21 is located below the filter base, illustrated in FIG. 2*b*. The filter 20 is flipped between the positions by applying a force on the filter 20 in the direction towards the opposite stable position. The filter 20 will flip position when the applied force exceeds the spring force of the filter.

Figure 3A:
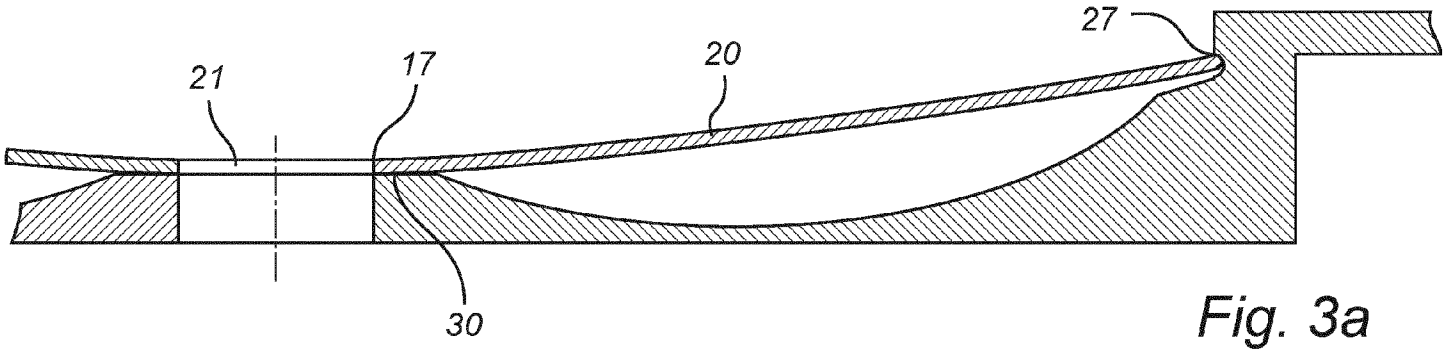
FIGS. 3*a* and 3*b* illustrates schematic cross sectional views of further embodiments of the invention.

In one favourable embodiment of the dishwasher, illustrated in FIG. 3*a*, a stationary support surface 30 is arranged below the filter 20 in the lower section of the washing chamber 11. The support surface 30 is arranged close to the centre of the filter and shaped like a ring that is in contact with the filter surface 22, or filter top surface. The support surface 30 could however also be positioned at different locations as long as it prevents the filter 20 from flipping all the way towards the stable shape of the filter. This means that when the filter 20 is flipped towards the securing shape of the filter, the support surface 30 will prevent the filter from fully reaching the stable shape. The outer periphery 26 of the filter 20 is then, due to the bistable characteristic of the filter, pushed upwards towards the contact surface 27 in the top section of the groove 24. This embodiment of the invention reduces the risk for water bypassing the filter further.

Figure 3B:
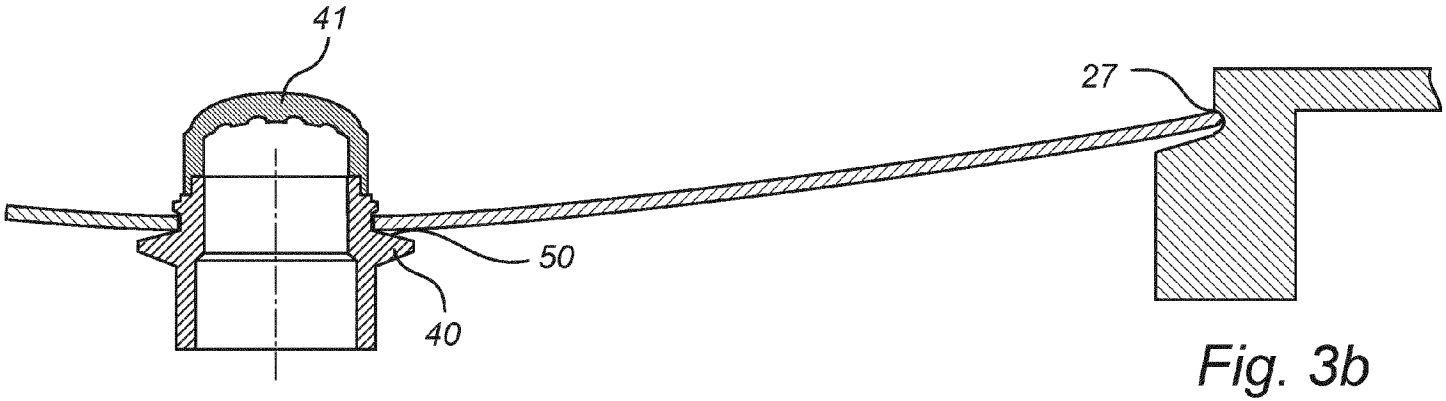

In a further embodiment of the invention, the filtering system comprises a central filter unit 40. The central filter unit 40 is substantially cylindrical and arranged in the centre of a filter 20, disclosed in FIG. 3*b*. The filter unit 40 is arranged in the opening 17 in the flat top surface of the filter 20. The shape of the opening is corresponding to the shape of the filter unit, preferably the opening is circular and central filter unit cylindrical, in order to avoid water bypassing between the filter opening and the filter unit. The filter unit 40 extend downwards from the filter substantially transverse to the plane of the filter base towards the lower section of the sump 16, not illustrated in the figures, and comprises passages for the water as well as for the collected waste material even though they are not illustrated in the figures. The filter unit furthermore comprises a handle 41 arranged on the top side of the filter. The handle could be used for applying the required force on the bistable filter 20 during mounting, or de-mounting, of the filter 20 and the filter unit 40 in the washing chamber 11.

The filter unit 40 is either separately secured in the sump 16 by matching securing means arranged somewhere in the sump and on the filter unit, not illustrated.

Alternatively, and preferably, the filter unit 40 is secured in the intended position by the bistable filter 20. This is achieved by arranging the support surface for the filter 20 on the filter unit 40. The support surface 50 is arranged around the outer periphery of the filter unit 40 in the area where the filter unit 40 is passing through the opening 17 in the filter 20 and positioned in such a way that it prevents the filter 20 from flipping all the way towards the stable shape of the filter. The filter, due to its bistable characteristic, is then pushed upwards towards the contact surface 27 and the filter unit 40 downwards into the sump 16, thereby securing both the filter 20 and the filter unit 40 in the desired positions. The force applied on the contact surface 27 and support surface 50 depends on the spring force of the filter.

Even though the water filtering system not comprises any central filter unit, the filter may be provided with an opening for transporting collected particles to a separate space in the sump where the collected waste particles could be removed from the washing chamber. The opening is preferably positioned in the lower section, or the flat surface, of the filter.

Figure 4:
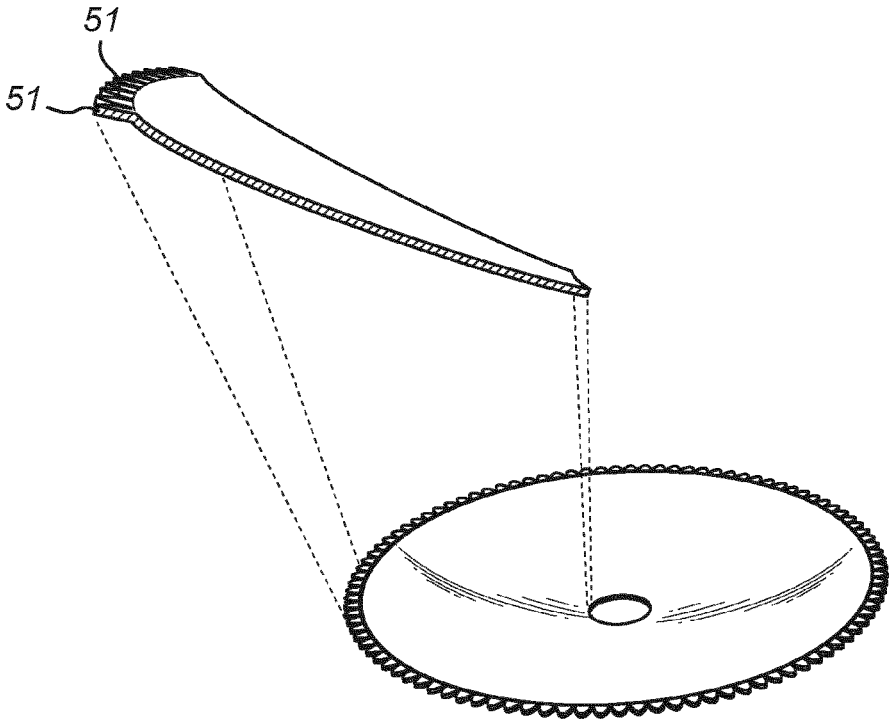
FIG. 4 illustrates a schematic perspective view of a further embodiment of a bistable filter.

A further embodiment of a bistable filter is illustrated in FIG. 4. The outer periphery of the filter according to this embodiment is provided with a number of protrusions 51 that extend from the outer periphery of the filter in a direction different from the direction of the filter outer periphery so that a change in filter diameter is achieved when the filter is flipped from one stable position towards the other. The protrusions 51 could have different shapes as long as they ensure that the required sealing between the filter periphery and the recess is achieved. The height of the protrusions should therefore not exceed the depth of the recesses. This embodiment is preferably used when a stronger fastening of the filter is desired since the filter is snapped into the intended position when the filter is in the shape with the smaller diameter and then flipped towards the shape where the protrusions 51 extend in substantially radial direction and the desired increase of the filter diameter is achieved in order to strengthen the fastening of the filter in the dishwasher.

Furthermore the dimensions of the supporting rim and the C-shaped groove could be changed as long as the modifications are combined with similar changes in the dimensions of the filter.

The different embodiments described above could all be combined in different ways without departing from the scope of the invention that is defined by the appended claims.

The invention claimed is:

1. A dishwasher comprising:

a washing chamber;

a water circulating system; and a water filtering system, said water filtering system is arranged in a lower part of the washing chamber, wherein the lower part defines a recess, wherein said water filtering system comprises a filter defining a filter surface, said filter surface configured to filter and allow at least some circulating water to pass therethrough, said filter having bistable characteristics such that the entire filter surface is flippable between two stable shapes wherein the filter is flippable from one stable shape of the filter surface to an other stable shape of the filter surface by a force applied on the filter in a direction toward the other stable shape, and wherein the filter is securable in the lower part of the washing chamber by flipping the filter from the one stable shape to the other stable shape, such that the filter is configured to engage the recess of the lower part of the washing chamber when flipped to the other stable shape.

2. The dishwasher according to claim 1, wherein said filter has an outer periphery positioned in the recess, said recess having a shape corresponding to a shape of the outer periphery of the filter.

3. The dishwasher according to claim 1, wherein the filter, in a plane of an outer periphery of the filter, has a filter base with a rectangular or triangular shape and said filter has a corresponding pyramid shape with a top angle of the pyramid exceeding 120° between the plane of the outer periphery and the filter surface when taken in a vertical plane relative to the dishwasher.

4. The dishwasher according to claim 1, wherein the filter, in a plane of an outer periphery of the filter, has a filter base with a circular or oval shape and a corresponding cone shape with a top angle of the cone exceeding 120° between the plane of the outer periphery and the filter surface when taken in a vertical plane relative to the dishwasher.

5. The dishwasher according to claim 1, wherein the filter, in a plane of an outer periphery of the filter, has a filter base, and wherein the filter is shaped with a flat top surface parallel to the filter base.

6. The dishwasher according to claim 5, wherein the water filtering system furthermore comprises a filter unit arranged in an opening in the top surface of the filter, said filter unit being connected to the filter and comprising a handle for mounting and/or de-mounting of the filter and the filter unit.

7. The dishwasher according to claim 6, wherein a support surface is arranged on the filter unit.

8. The dishwasher according to claim 2, wherein a number of protrusions are arranged around the outer periphery of the filter, said protrusions are extending away from a center of the filter in order to generate a change of a filter diameter when the filter is flipped from the one stable shape towards the other stable shape, and wherein the filter diameter is greater when the filter is in the other stable shape than when the filter is in the one stable shape.

9. A method for mounting the filter in the dishwasher of claim 1, said method comprising the steps of:

positioning an outer periphery of the filter in the recess while the filter is in the one stable shape;

applying a force on the filter in the direction towards the other stable shape of the filter thereby flipping the filter towards the other stable shape in order to secure the filter in the lower part of the washing chamber.

10. The method according to claim 9, wherein the applying the force comprises pressing the filter downwards.

11. The method according to claim 9, wherein the force applied on the filter must exceed a spring force of the filter in order to achieve the flipping of the filter from the one stable shape towards the other stable shape.

12. A dishwasher comprising;

a washing chamber;

a water circulating system; and a water filtering system, said water filtering system is arranged in a lower part of the washing chamber, wherein the lower part defines a recess, wherein said water filtering system comprises a filter configured to allow at least some circulating water to pass therethrough, said filter having bistable characteristics such that the filter has two stable shapes, wherein the filter is flippable from one stable shape to an other stable shape by a force applied on the filter in a direction toward the other stable shape, and the filter is securable in the lower part of the washing chamber by transitioning the filter from the one stable shape to an intermediary shape between the two stable shapes of the filter, such that transitioning the filter from the one stable shape to the intermediary shape is configured to cause the filter to engage the recess of the lower part of the washing chamber.

13. The dishwasher according to claim 12, wherein said filter is arranged between a contact surface of the recess and a support surface stationary in relation to the washing chamber and positioned in such a way that the filter is maintained in the intermediary shape and an outer periphery of the filter is pressed against the contact surface of the recess.

14. The dishwasher according to claim 13, wherein the filter, in a plane of the outer periphery of the filter, has a filter base, and wherein the filter is shaped with a flat top surface parallel to the filter base.

15. The dishwasher according to claim 14, wherein the water filtering system furthermore comprises a filter unit arranged in an opening in the top surface of the filter, said filter unit being connected to the filter and comprising a handle for mounting and/or de-mounting of the filter and the filter unit.

16. The dishwasher according to claim 15, wherein the support surface is arranged on the filter unit.

* * * * *